US005964264A

United States Patent [19]

Kokko

[11] Patent Number: 5,964,264

[45] Date of Patent: Oct. 12, 1999

[54] MATERIAL STRANDER AND METHODS THEREFOR

[75] Inventor: Pekka Kokko, Hollola, Finland

[73] Assignee: Andritz-Patentverwaltungs-GmbH, Graz, Australia

[21] Appl. No.: 09/175,842

[22] Filed: Oct. 20, 1998

[30] Foreign Application Priority Data

Oct. 21, 1997 [FI] Finland ..... 974015

[51] Int. Cl.[6] ..... B27L 11/00

[52] U.S. Cl. ..... 144/373; 144/162.1; 144/172; 144/180; 144/242.1; 241/92

[58] Field of Search ..... 144/162.1, 172, 144/174, 180, 242.1, 373; 241/92, 228.2

[56] References Cited

U.S. PATENT DOCUMENTS 3,913,643 10/1975 Lambert ..... 144/180
4,583,574 4/1986 Pallmann ..... 144/180
4,784,198 11/1988 Pallmann ..... 144/172
5,485,873 1/1996 Crammond .
5,647,417 7/1997 Schaefer et al. ..... 144/172

*Primary Examiner*—W. Donald Bray
*Attorney, Agent, or Firm*—Alix, Yale & Ristas, LLP

[57] ABSTRACT

An improved strander, and methods of operating the same, alternately delivers material into a housing element through at least two feeding points so that material fed through the first feeding point can be stranded during movement of the housing element in a first direction. Material fed into the strander through the second feeding point can be stranded by the housing element on its return movement in a second direction. Thus, the stranding process can continue nearly continuously throughout each working cycle.

15 Claims, 3 Drawing Sheets

MATERIAL STRANDER AND METHODS THEREFOR

BACKGROUND OF THE INVENTION

1. Field of the Invention

The present invention generally relates to improved methods and apparatus for stranding materials. More particularly, the invention relates to an improved strander and methods of operating the same to improve the efficiency thereof. Accordingly, the general objects of the present invention are to provide novel and improved methods and apparatus of such character.

2. Description of the Related Art

Apparatus for stranding materials are well known in the art. These related art stranders are commonly used for stranding wood and especially timber or logs which are generally cylindrical in shape. Such stranders typically include a rotatable housing element having stranding blades on the interior of the housing element and means for delivering wood into the housing element. The housing element is typically in the shape of a hollow cylinder which rotates about a rotation axis and is designed to move relative to the wood to be stranded in working cycles. The stranding blades are periodically disposed on the interior of the housing element such that the blades cut into the wood upon rotation and cyclical movement of the housing element. One example of a strander of the related art is provided in U.S. Pat. No. 5,485,873 which issued to Crammond on Jan. 23, 1996. The contents of this patent are hereby incorporated by reference to provide further details regarding the structure and function of conventional stranders and strander components.

A major deficiency of the above-described conventional stranders is that the cutting blades only engage the wood to be stranded during a relatively small portion of the entire stranding operation. Specifically, conventional stranders are inefficient in that the housing element only strands the wood while moving in a single direction relative to the feeding point. Therefore, the cutting blades of the housing element do not strand the wood during the return movement of the housing element. Additional inefficiencies arise from the need to feed additional timber into the strander prior to commencing additional cycles of the strander. Thus, the housing element must remain stationary in an end position until additional wood is fed into the strander. Accordingly, the stranders of the related art spend little time actually stranding the timber.

Therefore, there remains a need in the art for an improved strander and methods of operating the same which overcomes the aforementioned deficiencies of the related art by increasing the efficiency of the stranding process.

SUMMARY OF THE INVENTION

It is, accordingly, an object of the invention to provide stranding apparatus, and methods of operating the same, which improve the efficiency of the stranding process.

These and other objects and advantages of the present invention are provided in one embodiment by an improved strander of the general type described above which alternately delivers material into the housing element through at least two feeding points. Material fed through a first feeding point can be stranded by rotating the housing element and moving one of the material or the housing element in a first direction. Similarly, material fed into the strander through a second feeding point can be stranded by the moving housing element or material on its return movement in a second direction. An additional feature of the present invention permits delivery of material to be stranded through one of the feeding points while material previously delivered through the other feeding point is being stranded. Thus, by employing the methods and apparatus of the present invention, the stranding process can continue nearly continuously throughout each working cycle.

BRIEF DESCRIPTION OF THE DRAWINGS

The preferred embodiment of the present invention will be described below with reference to the accompanying drawings wherein like numerals represent like structures and wherein.

DESCRIPTION OF THE PREFERRED EMBODIMENT

One preferred embodiment of the present invention will be described below with joint reference to FIGS. 1–3. It will be appreciated that, while the strander of FIGS. 1–3 is primarily intended for stranding wood or timber (especially round wood such as logs), it is also capable of stranding a wide variety of other materials known in the art.

Figure 1:
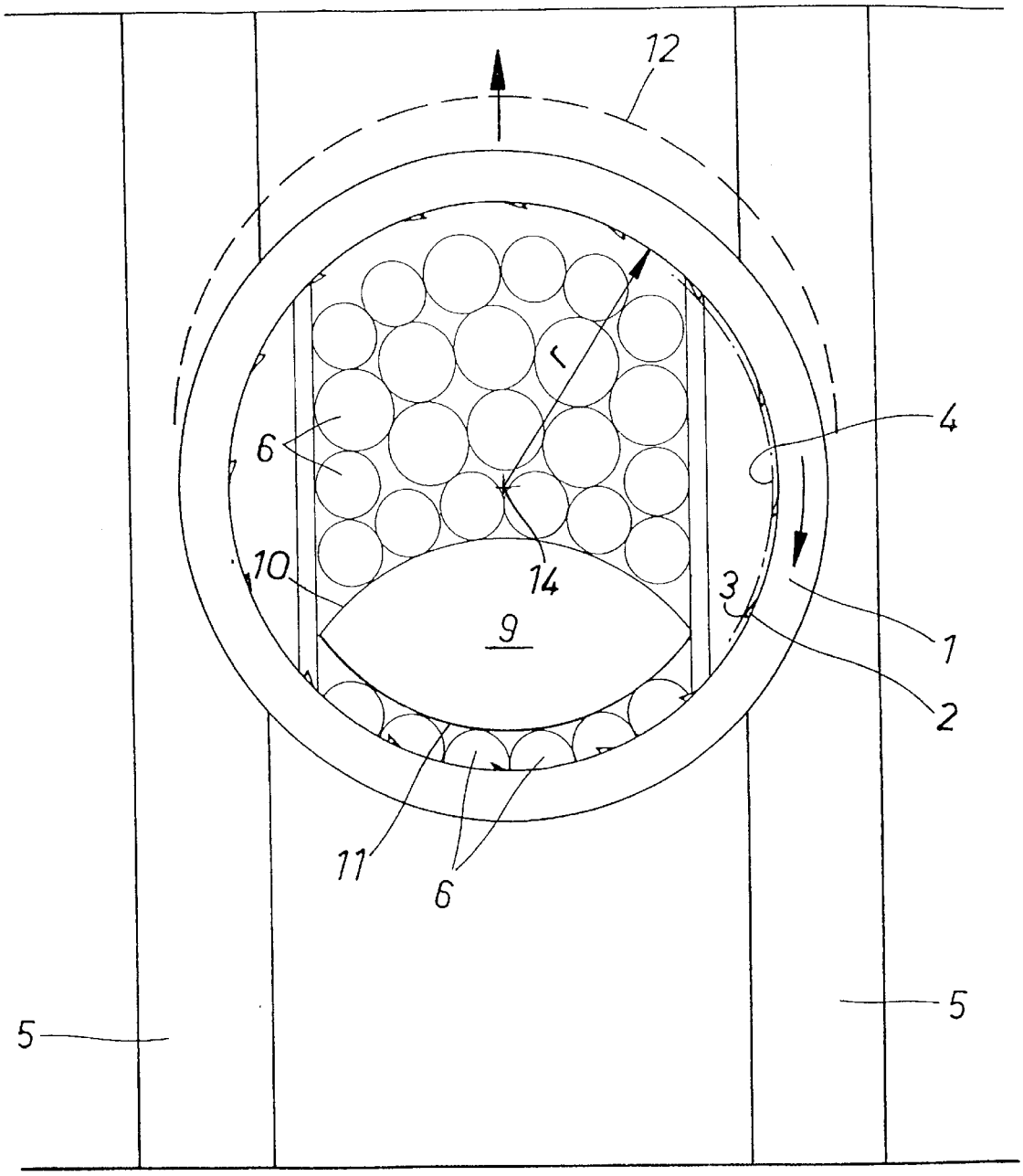
FIG. 1 shows a schematic end view of a strander in accordance with one preferred embodiment wherein the housing element is approaching one end position.
Figure 2:
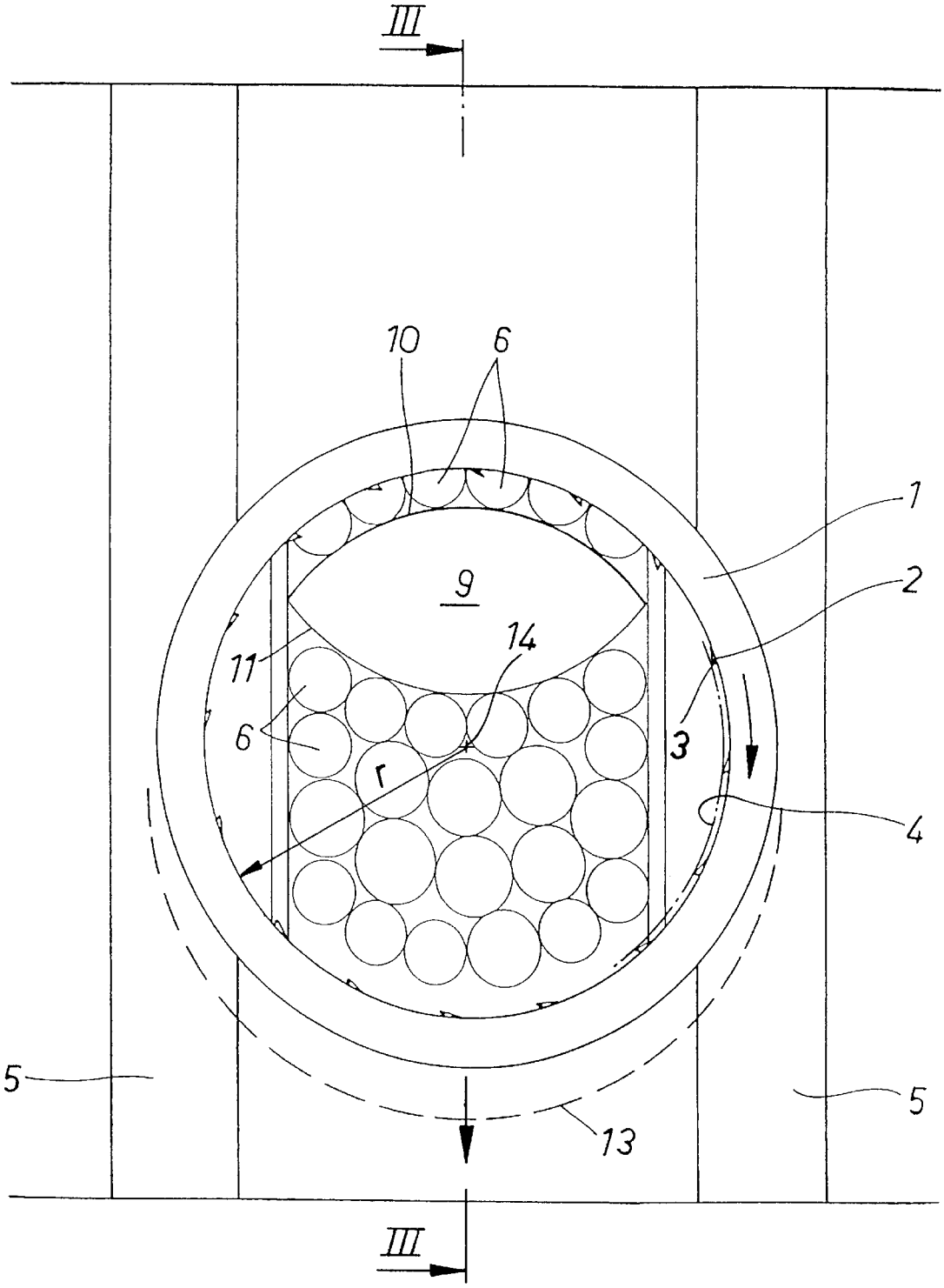
FIG. 2 illustrates the strander of FIG. 1 as the housing element is approaching another end position.
Figure 3:
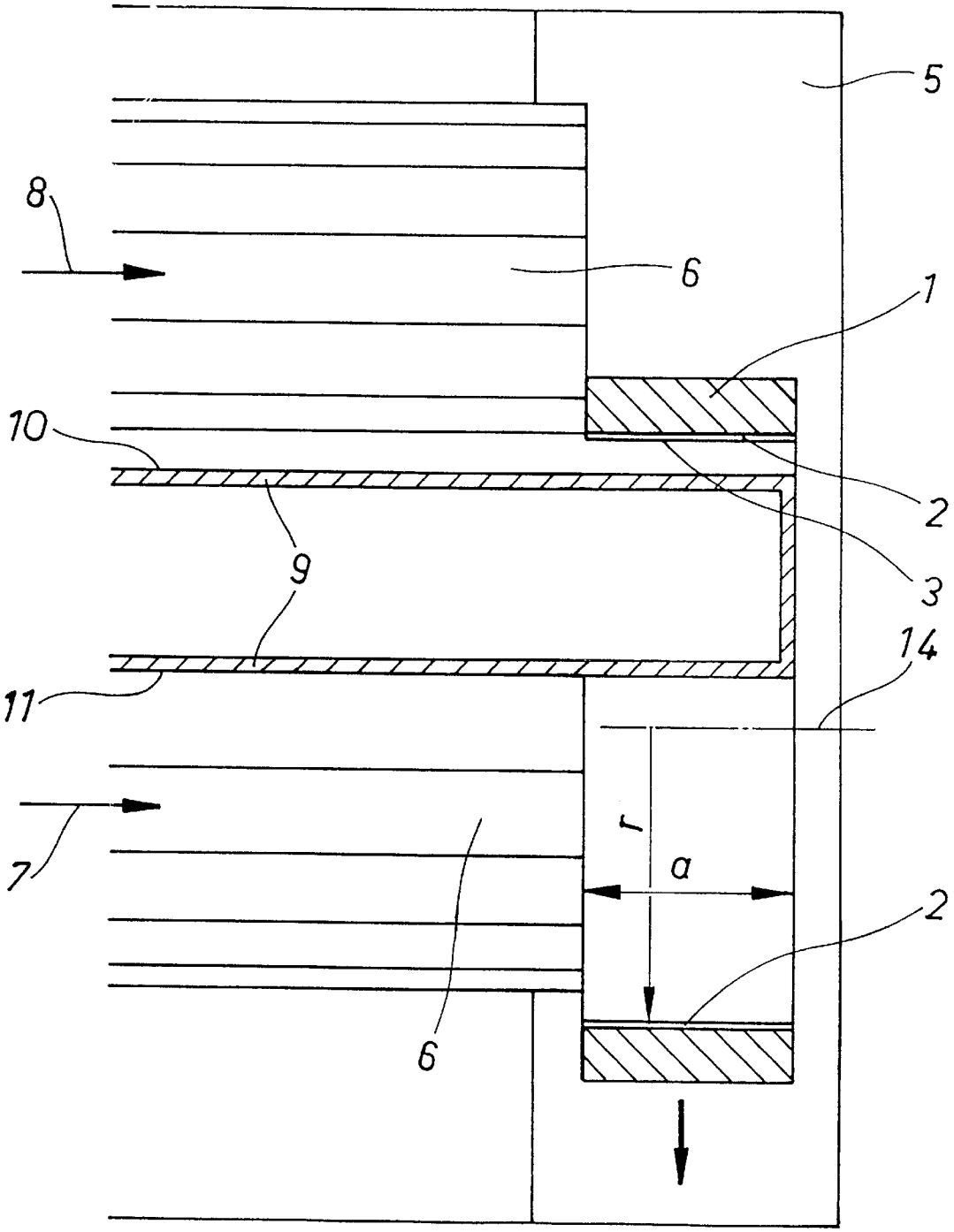
FIG. 3 is a sectional view of the inventive strander of FIG. 2, the section being taken along line III—III of FIG. 2.

As shown in FIGS. 1–3, the strander of the present invention includes a rotatable housing element 1 having a plurality of cutting blades 2 periodically disposed along the interior of housing element 1. Housing element 1 is capable of rotating about an axis 1 4 such that cutting edges 3 of blades 2 are equidistant from axis 14 along a radius r. While housing element 1 is illustrated as being generally cylindrical with blades 2 located on the interior thereof, housing element 1 could, alternatively, take the form of a tool shaft with blades 2 disposed on the outer surface thereof as long as cooperating components of the strander were also suitably modified. Such modifications are well within the ordinary skill in the art.

The inventive strander also includes means 5 for moving the wood 6 to be stranded and housing element 1 relative to one another. Means 5 for moving can be any one of a wide variety of known moving devices such as a carriage having slide bars with cooperating hydraulic cylinders as well as those means disclosed in the incorporated reference. With respect to the preferred embodiment, the means for moving 5 is designed to move housing element 1 linearly and reciprocally while wood 6 remains stationary. Another equivalent arrangement would permit wood 6 to move linearly and reciprocally relative to the stationary housing element. Yet another equivalent arrangement would permit both wood 6 and housing element 1 to move relative to one another simultaneously. The preferred embodiment of the present invention employs linear vertical motion of housing element 1 during the stranding process. However, an equivalent alternative would be to utilize lateral movement, i.e., movement in a horizontal direction. Curved movement paths are also compatible with the invention.

As shown in FIGS. 1–3, the preferred apparatus of the invention utilizes two feeding points, indicated by arrows 7, 8 (FIG. 3), defined between housing element 1 and support member 9 and on opposite sides of support member 9. During operation, wood 6 is alternately delivered into the housing element of the strander through first and second feeding points 7, 8. The feeding distance represents the length of wood desired to be stranded during one stranding cycle. This distance is, in part, determined by the length of the housing element and distance "a" (FIG. 3) represents the maximum length of wood that can be stranded at one time. The means for delivering the material to be stranded can be any one of a wide variety of known delivering devices such as a guide with a cooperating thrust plate as well as those means disclosed in the incorporated reference. With respect to the preferred embodiment, the means for delivering is designed to deliver wood at least substantially parallel to the rotation axis of the housing element.

The strander of the present invention also includes a preferably immobile support member 9 which is preferably lens-shaped in cross-section. Support member 9 is preferably at least partially maintained within the interior of housing element 1 so that wood or timber 6 delivered through feeding point 8 will bear against a top surface 10 of support member 9. Similarly, wood 6 delivered through feeding point 7 will bear against bottom surface 11 of support member 9.

In FIG. 1, the preferred strander is illustrated as being close to its first end position wherein housing element 1 approaches its vertically highest (i.e., top) position. The highest position of housing element 1 is designated with dotted line 12. Thus, the portion of wood 6 which was previously delivered to the interior of housing element 1 through first feeding point 7 is nearly completely stranded. Since, in this position, support member 9 is relatively close to housing element 1, additional timber 6 can be delivered into the space between top surface 10 of support member 9 and housing element 1 through second feeding point 8. Since the wood 6 on the lower side of support member 9 is still being stranded while wood is delivered above the top surface of support member 9, there is no down-time associated with feeding an additional length of wood 6 into the housing element 1. In other words, efficiency is enhanced because wood 6 is fed into position through feeding point 8 not later than the time at which housing element 1 commences its downward movement and cutting blades 2 begin to cut the timber 6 delivered through the second feed point 8.

A second and similar condition of the strander of the present invention is illustrated in FIG. 2. The primary difference between FIGS. 1 and 2 is that in FIG. 2, housing element 1 is approaching its lowest end position. The bottom position of housing element 1 is indicated with dotted line 13. With joint reference to FIGS. 2 and 3, one can see that in the condition of FIG. 2, the wood 6 previously delivered through feeding point 8 is almost completely stranded. This condition permits wood 6 to be delivered into housing element 1 through feeding point 7 so that this wood can be stranded when housing element 1 recommences its upward movement.

Those of ordinary skill will recognize that there is a short period of time immediately after housing element 1 changes direction wherein cutting blades 2 do not engage timber 6. An optional feature of the present invention entails high speed motion of housing element 1 during this brief time period in order to further increase efficiency. Still further increases in efficiency can be achieved by selecting and arranging logs for delivery into the strander so as to minimize the above-mentioned time period. For example, logs 6 should be selected by diameter and arranged to nearly entirely fill the space between the interior of housing element 1 and support member 9.

While the present invention has been described in connection with what is presently considered to be the most practical and preferred embodiments, it is to be understood that the invention is not limited to the disclosed embodiments, but is intended to cover various modifications and equivalent arrangements included within the spirit and scope of the appended claims.

I claim:

1. A method of operating a strander of the type having a rotating housing element which defines a rotation axis and a housing element interior, stranding blades disposed on the interior of the housing element, means for delivering material to the housing element, means for moving at least one of the material and the housing element relative to one another and at least first and second feeding points through which material may be delivered into the housing element, said method comprising:

(a) delivering material a predetermined distance into the interior of the housing element through one of the first and second feeding points in a direction which is substantially parallel to the rotation axis;

(b) moving at least one of the material and the housing element relative to one another in a first direction which is substantially perpendicular to the rotation axis to thereby strand the material until at least substantially all of the material within the interior of the housing element has been stranded, said step of moving (b) occurring after said step of delivering (a) is at least partially completed;

(c) delivering material a predetermined distance into the interior of the housing element through the other of the first and second feeding points in a direction which is substantially parallel to the rotation axis, said step of delivering (c) occurring after said step of moving (b) is at least partially completed;

(d) moving at least one of the material and the housing element relative to one another in a second direction which is substantially perpendicular to the rotation axis to thereby strand the material until at least substantially all of the material within the interior of the housing element has been stranded, said step of moving (d) occurring after said step of delivering (c) is at least partially completed.

2. The method of claim 1 wherein said step of moving (b) begins after said step of delivering (a) has been entirely completed; and said step of moving (d) begins after said step of delivering (c) has been entirely completed.

3. The method of claim 1 wherein said step of moving (b) comprises moving at least one of the material and the housing element relative to one another in a first direction which is substantially perpendicular to the rotation axis to thereby strand the material until all of the material within the interior of the housing element has been stranded, said step of moving (b) occurring after said step of delivering (a); and said step of moving (d) comprises moving at least one of the material and the housing element relative to one another in second direction which is substantially perpendicular to the rotation axis to thereby strand the material until all of the material within the interior of the housing element has been stranded, said step of moving (d) occurring after said step of delivering (c).

4. The method of claim 1 wherein said step of moving (b) further comprises moving at least one of the material and the housing element more quickly when the material is not being stranded than when the material is being stranded; and said step of moving (d) further comprises moving at least one of the material and the housing element more quickly when the material is not being stranded than when the material is being stranded.

5. The method of claim 1 wherein said step of delivering (a) further comprises selecting and arranging the material to be delivered such that the time period of said step of moving (b) during which the material is not being stranded is minimized; and said step of delivering (c) further comprises selecting and arranging the material to be delivered such that the time period of said second step of moving during which the material is not being stranded is minimized.

6. The method of claim 1 wherein steps (a) through (d) are cyclically repeated.

7. The method of claim 1 wherein said step of moving (b) comprises linearly moving the housing element while the material remains stationary; and said step of moving (d) comprises linearly moving the housing element while the material remains stationary.

8. A strander for stranding material comprising:

a housing element with an interior and stranding blades disposed on said interior of said housing, said housing being rotatable about a rotation axis;

a support member at least partially disposed within the interior of said housing, said housing and said support member cooperating to define first and second feeding points on opposite sides of said support member through which material may pass into said interior of said housing;

means for delivering material a predetermined distance through at least one of said first and second feeding points and into said interior of said housing in a direction which is substantially parallel to said rotation axis; and means for moving at least one of said housing and said support member relative to one another in a direction which is substantially perpendicular to said rotation axis whereby said stranding blades strand the material within said interior of said housing element when said housing is rotated.

9. The strander of claim 8 wherein said support member is lens-shaped in cross-section.

10. The strander of claim 8 wherein said means for moving comprises means for linearly moving said housing element substantially perpendicular to said rotation axis while said support member remains stationary.

11. The strander of claim 8 wherein said means for delivering comprises means for alternately delivering material through said first and second feeding points and into said interior of said housing element.

12. A strander for stranding material comprising:

a housing element with an interior and stranding blades disposed on said interior of said housing, said housing being rotatable about a rotation axis;

a support member at least partially disposed within the interior of said housing, said housing and said support member cooperating to define first and second feeding points on opposite sides of said support member through which material may pass into said interior of said housing;

a material-guide having a cooperating thrust plate for delivering material a predetermined distance through at least one of said first and second feeding points and into said interior of said housing in a direction which is substantially parallel to said rotation axis; and a carriage for moving at least one of said housing and said support member relative to one another in a direction which is substantially perpendicular to said rotation axis whereby said stranding blades strand the material within said interior of said housing element when said housing is rotated.

13. The strander of claim 12 wherein said support member is lens-shaped in cross-section.

14. The strander of claim 12 wherein said carriage includes means for linearly moving said housing element substantially perpendicular to said rotation axis while said support member remains stationary.

15. The strander of claim 12 wherein said material-guide includes means for alternately delivering material through said first and second feeding points and into said interior of said housing element.

* * * * *